United States Patent [19]

Boxer et al.

[11] 4,099,639

[45] Jul. 11, 1978

[54] CHILD RESISTANT CLOSURE

[75] Inventors: Leo M. Boxer; Robert W. Boxer, both of Fox Point, Wis.

[73] Assignee: Lewis, Pauls & Associates, Ltd., Miami, Fla.

[21] Appl. No.: 797,565

[22] Filed: May 16, 1977

[51] Int. Cl.[2] ..... B65D 55/02; B65D 85/56; A61J 1/00

[52] U.S. Cl. ..... 215/209; 215/216; 215/221

[58] Field of Search ..... 215/209, 216, 221

[56] References Cited

U.S. PATENT DOCUMENTS

| | | | |
|---|---|---|---|
| 3,892,326 | 7/1975 | Schneible | 215/221 |
| 4,011,829 | 3/1977 | Wachsmann et al. | 215/216 |

*Primary Examiner*—George T. Hall

*Attorney, Agent, or Firm*—Shoemaker and Mattare, Ltd.

[57] ABSTRACT

A child resistant closure for a container having a threaded neck. The closure comprises a cap including a disc-shaped end wall and an internally threaded depending cylindrical side wall or skirt having an annular bottom end surface. A yieldable ledge or collar is on the neck of the container in a position to be engaged by the end surface of the cap side wall when the cap is threaded fully onto the neck of the container, and a shaped, interfitting lug and recess are on the collar and cap end surface in a position to be automatically interengaged everytime the cap is threaded fully onto the container to lock the cap in a fully closed position on the container. The collar is yieldable to enable selective release of the lug and recess to thereby enable retrograde movement of the cap from the threaded neck.

12 Claims, 14 Drawing Figures

CHILD RESISTANT CLOSURE

BACKGROUND OF THE INVENTION

This invention relates to closures for containers, and more particularly relates to a safety closure for a container which holds potentially dangerous products, such as drugs, cleaning solutions, caustics, volatile liquids and the like. In recent years Government regulations and public concern are requiring more and more of these products to be packaged in containers that are resistant to being opened by children. At the same time, the containers must be relatively simple to be opened by adults. Otherwise, the object of the regulations would be defeated, since a container that is too difficult to open or reclose by an adult would be frequently left open by adults. Moreover, it is desirable in containers to have some means for insuring that the closure or cap is not over-tightened or under-tightened during use, and also, some means for preventing accidental loosening of the cap during handling, shipping or storage is desired.

In the prior art various attempts have been made to solve the above problems and provide a closure which meets the requirements of the law. Such closures are exemplified, for example, in U.S. Pat. Nos. 3,841,514, 3,891,110 and 3,939,788. In U.S. Pat. No. 3,841,514 the closure is constructed to be squeezed on diametrically opposite sides thereof to release latching or locking lugs on the closure and container. U.S. Pat. No. 3,891,110 discloses a closure having a yieldable seal means in the end thereof which engages the end of the container and an outwardly directed annular flange is on the bottom edge of the closure and has a plurality of lugs thereon for cooperation with interengaging structure on the container, whereby the closure may be threaded onto the container and latching or locking will be effected between the closure and container by cooperation between the lugs thereon. The lugs include a plurality of circumferentially spaced lugs to insure that the closure will be locked even though the rotational position thereof on the container may be different from other closures on like containers. U.S. Pat. No. 3,939,788 discloses a device wherein a pair of opposite wing members are secured on the neck of the container with lug means thereon for cooperation with lugs or recesses inside an enlarged skirt portion of the cap or closure. In operation of this closure it is necessary to simultaneously pull both wings downwardly in order to release the interengaging detents to release the cap.

The present invention solves the problems found in the prior art devices by providing a closure cap of relatively rigid material which cooperates with a threaded neck on a container in a manner whereby the closure is in substantially the same circumferential position every time it is threaded fully onto the threaded neck, and a flexible collar on the neck cooperates with detent means on the bottom edge of the cap to make the cap child resistant and yet enables it to be opened relatively easily by an adult. Moreover, the cap is not likely to accidentially be loosened during handling, storing and shipping and it is economical to manufacture, since expensive modifications to existing machinery and dies will not be necessary. Moreover, the invention may be applied to either a plastic, metal or glass container and may even be utilized on a container having an internally threaded neck.

OBJECTS OF THE INVENTION

Accordingly, it is an object of this invention to provide a safety closure for rendering a container child resistant and yet which is at the same time easy to operate by an adult.

Another object of the invention is to provide a safety closure which is usable with metal, plastic or glass continers.

A still further object of the invention is to provide a safety closure for containers wherein the closure is adpated to be threaded onto the container and includes detent or locking structure which may be economically manufactured and does not require extensive modifications to existing machinery.

A further object of the invention is to provide a safety closure for containers wherein the closure is threaded onto the container and is constructed to assume the same circumferential position each time it is threaded fully onto the container and which has cooperating locking means on the container and closure proper tightening of the closure each time. Also, the closure is prevented from being accidentally loosened during handling, storing and shipping.

A still further object of the invention is to provide an adaptor for threaded engagement with a container and wherein the adaptor has a flexible collar thereon and external threads for cooperation with a cap in accordance with the invention, whereby a cap in accordance with the invention may be used on a container having an internally threaded neck.

DETAILED DESCRIPTION OF THE INVENTION

Figure 1:
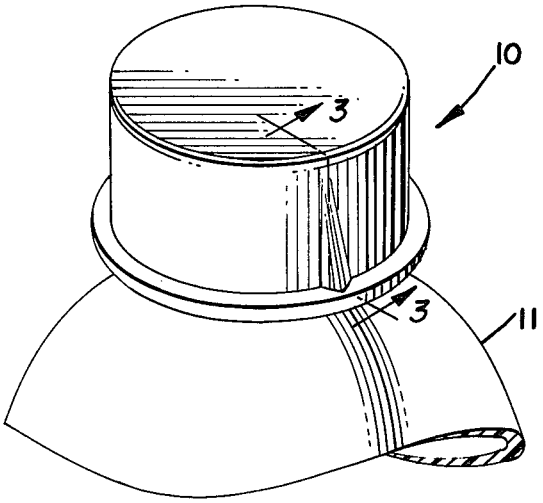
FIG. 1 is a fragmentary perspective view of a portion of a container and a closure in accordance with a first form of the invention.
Figure 2:
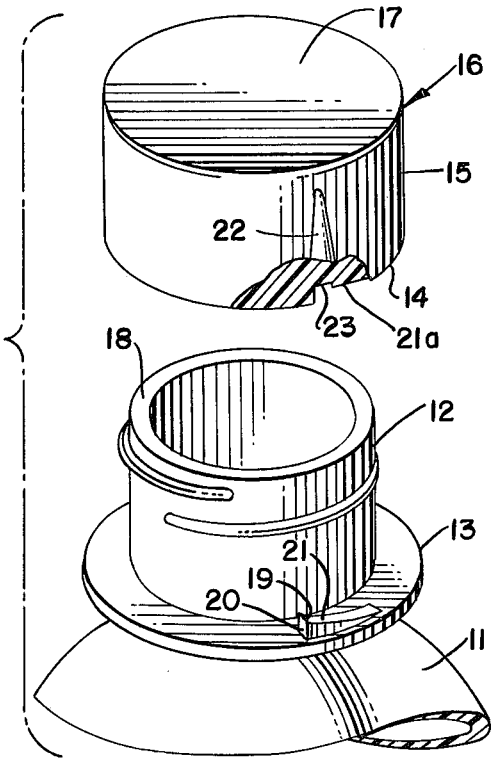
FIG. 2 is an exploded perspective view of the container and closure of FIG. 1.
Figure 3:
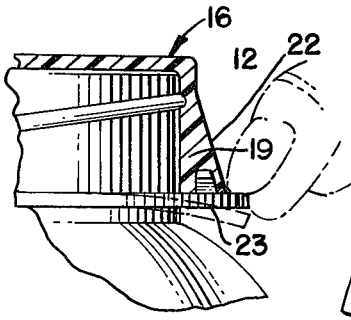
FIG. 3 is an enlarged fragmentary view in section taken along line 3—3 in FIG. 1.

In the drawings, wherein like reference numerals indicate like parts throughout the several views, a first and preferred form of the invention is indicated generally at 10 in FIGS. 1, 2 and 3 and comprises a container 11 of a suitable material, such as plastic or the like, having a threaded neck 12 projecting upwardly therefrom and an integral annular outwardly extending collar or flange 13 thereon in a positon to cooperate with the bottom annular edge 14 of the cylindrical side wall 15 of closure or cap 16. The closure has a disc-shaped top or end wall 17 which seats on the upper annular edge 18 of the neck 12 when the cap is threaded fully onto the neck of the container. A suitable seal means may be provided between the end of the container neck and the cap, other than the material of the cap or neck.

The collar 13 has an upstanding lug 19 formed thereon with a generally vertical surface 20 and a sloping or inclined ramp surface 21 leading upwardly from the top surface of the collar 13. The skirt 15 of the closure 16 has a radially enlarged formation 22 thereon defining a downwardly opening recess or pocket 23 into which the lug or projection 19 is received when the closure 16 is threaded fully onto the neck 12 of the container. The ramp 21 facilitates threaded positioning of the cap on the neck, since it forms a lead-in to the recess or pocket 23. Also, the cap skirt has a similarly shaped recess 21*a* for receiving the ramp 21 when the cap is threaded fully onto the neck. On the other hand, the vertical or straight surface 20 prevents retrograde movement of the cap. When it is desired to remove the cap from the container, it is simply necessary to push downwardly with the finger F against the collar 13 to disengage the lug 19 from the recess 23, whereby retrograde threaded movement of the cap from the container can be accomplished.

The cap or closure 16 is preferably made of a relatively rigid plastic material of any suitable type presently commercially available and as presently being used for some closures, such that the cap will always assume the same circumferential position when it is threaded fully onto the threaded neck, thus insuring proper cooperation between the lug 19 and recess 23 each time the cap is threaded fully onto the container. The outwardly projecting formation 22 provides an indication or indicator of the location of the lug 19, whereby the collar 13 may be accurately engaged to release the lug from the recess.

Thus, with the invention, the container may be held in one hand and one finger or thumb engaged against the collar urging it downwardly to enable retrograde movement of the cap.

Figure 5:
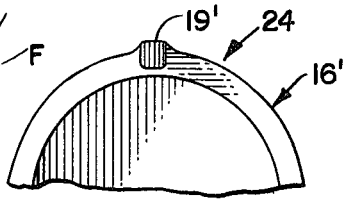
FIG. 5 is a fragmentary view taken along line 5—5 in FIG. 4.
Figure 4:
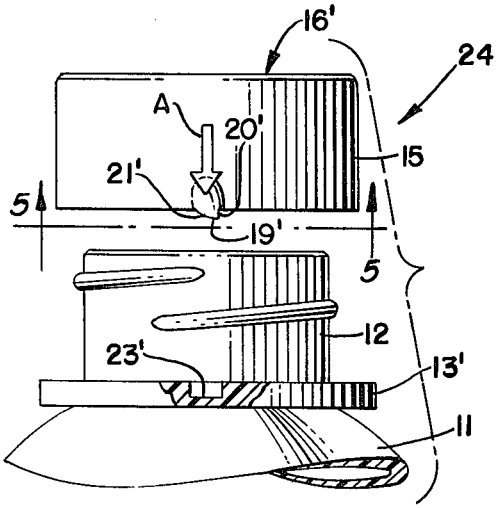
FIG. 4 is a fragmentary exploded view in elevation of a second form of container and closure according to the invention.

In some cases it may be more desirable to have the projection 19 on the cap skirt and the recess 23 in the collar, since the projection would then act to deflect the skirt as the cap approaches its fully closed position. This arrangement is shown in FIGS. 4 and 5, wherein a second form of the invention is indicated generally at 24, and in this form of the invention the collar 13' has the recess or pocket 23' therein and the lug 19' with its sloping ramp surface 21' and straight or vertical surface 20' is on the bottom edge of the skirt 15 of the cap 16'. Suitable indicia, such as an arrow A or the like, may be provided on the outer surface of the skirt 15 in alignment with the lug 19' to facilitate accurate manipulation thereof. Further, the recess 23' may comprise a hole completely through the collar, if desired.

Figure 6:
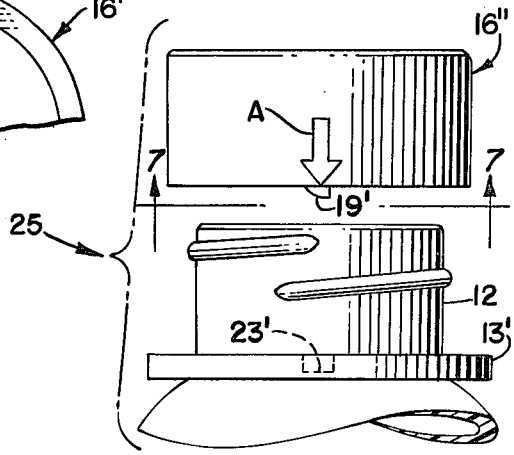
FIG. 6 is a view similar to FIG. 4 of a third form of the invention.
Figure 7:
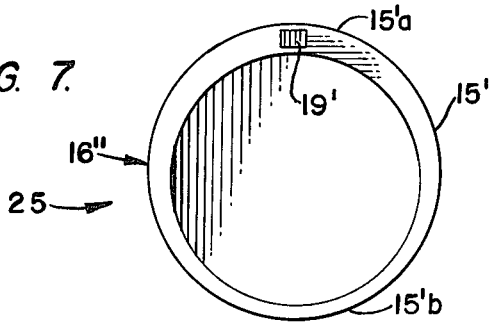
FIG. 7 is a view taken along line 7—7 in FIG. 6.

A third form of the invention is indicated generally at 25 in FIGS. 6 and 7, and in this form of the invention the container 11 has a collar 13' on the neck 12 thereof with a recess or pocket 23' therein, as in the FIG. 4 embodiment, but in this form of the invention, the cap 16'' has one side of the side wall 15' thereof radially thickened at *-'a*, in comparison with the diametrically opposite side 15'*b* to provide space or room for the lug 19' which cooperates with the recess 23'. In all other respects this form of the invention is substantially identical to that shown in FIGS. 4 and 5.

Figure 8:
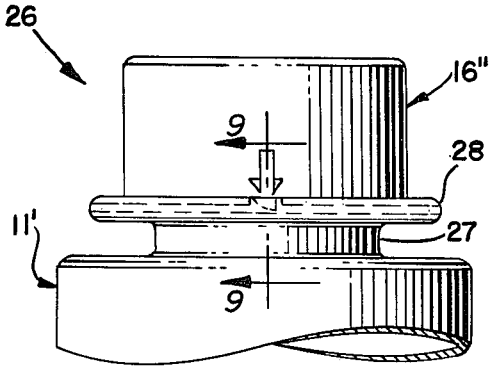
FIG. 8 is a fragmentary view in elevation of a fourth form of container and closure according to the invention.
Figure 9:
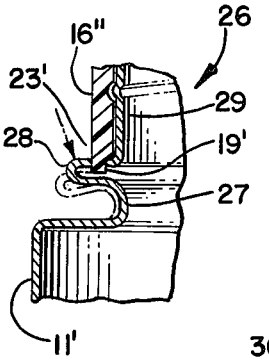
FIG. 9 is a fragmentary view in section taken along line 9—9 in FIG. 8.

A fourth form of the invention is indicated generally at 26 in FIGS. 8 and 9, and in this form of the invention the container 11' comprises a metallic container having a reduced diameter neck portion 27 radially enlarged at 28 to define a spring-like ledge or collar. Projecting above the collar and integral with the neck portion is a threaded neck 29 for cooperation with a cap 16'' as in the form of the invention in FIG. 6. In this form of the invention, the cap 16'' is threaded onto the neck 29 until the lug 19' on the bottom edge of the cap enters into the recess 23' in the collar or ledge 28. When it is desired to remove the cap, the collar is flexed downwardly, as indicated in phantom line in FIG. 9, to release the lug 19' from the recess 23' and enable retrograde movement of the cap 16'' from the neck 29.

Figure 11:
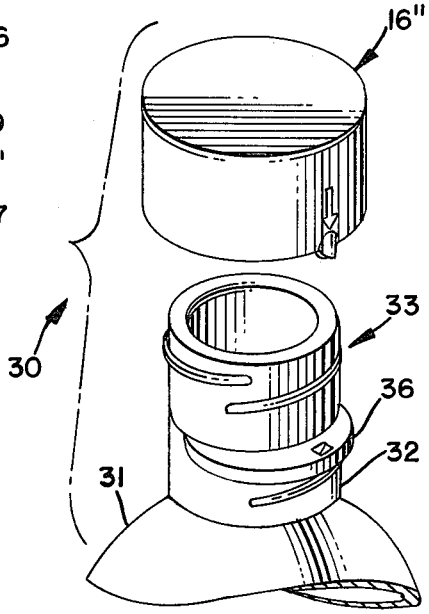
FIG. 11 is a partially exploded perspective fragmentary view of the form of the invention in FIG. 10, showing the insert or adaptor assembled to the container.
Figure 10:
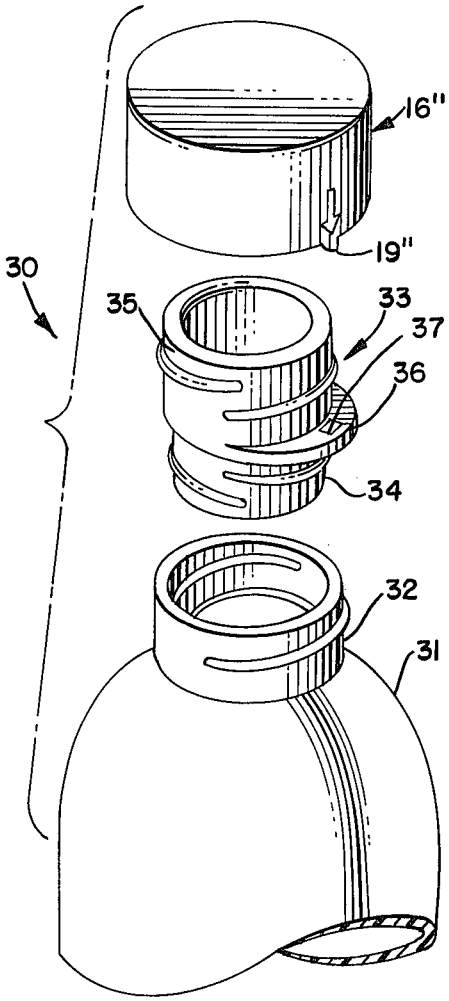
FIG. 10 is an exploded perspective view of a portion of a container and an insert and closure according to a fifth form of the invention.
Figure 12:
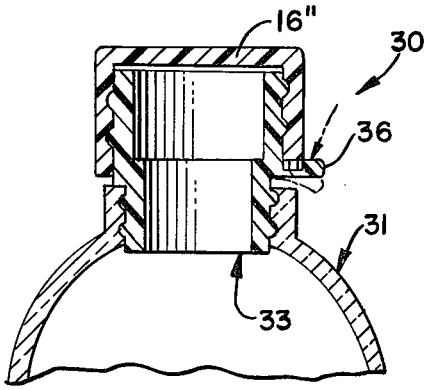
FIG. 12 is a fragmentary view in section of the form of the invention shown in FIGS. 10 and 11.

A fifth form of the invention is indicated generally at 30 in FIGS. 10, 11 and 12, and in this form of the invention a container 31 has an internally threaded neck 32 thereon for cooperation with a stopper-type threaded cap. An adaptor 33 in accordance with the invention has an externally threaded end portion 34 for mating cooperation with the internally threaded neck 32 on the container and an upwardly projecting, externally threaded neck 35 for cooperation with a cap 16'' as in the previously described forms of the invention. A yieldable ledge or flange 36 having a recess 37 therein is formed on one side of the adaptor 33 for cooperation with the lug 19' on the cap 16''. In use of this form of the invention, the adaptor 33 is merely threaded into the neck 32 of container 31 and then suitably secured therein, as by means of an adhesive or solder or the like. Thereafter, the cap 16'' may be applied to and removed from the threaded neck 35 of adaptor 33 just as in the previous forms of the invention.

Figure 13:
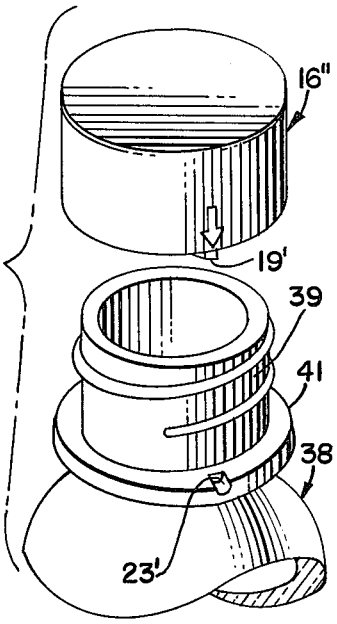
FIG. 13 is a fragmentary exploded perspective view of a sixth form of container and closure according to the invention.
Figure 14:
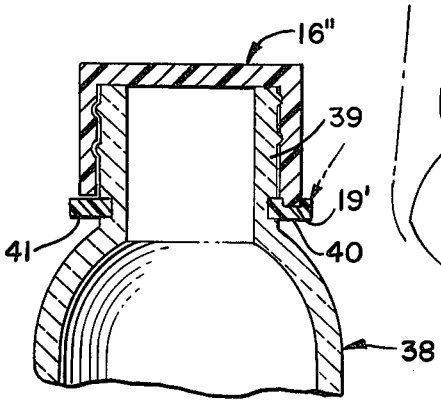
FIG. 14 is a fragmentary view in section of the form of the invention shown in FIG. 13.

A sixth form of the invention is indicated generally at 37 in FIGS. 13 and 14. In this form of the invention, a container 38 has an externally threaded neck 39 with a circumferential channel or recess 40 formed therein adjacent the base of the neck. A flexible or yieldable collar or ring 41 is snapped or fitted into the channel 40 for cooperation with a cap 16'' such as in the previous forms of the invention.

It will be noted that the containers 31 and 38 are made of glass and a flexible collar is secured thereto for cooperation with the respective caps.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly ccoperative equivalents are, therefore, intended to be embraced by those claims.

We claim:

1. A child resistant closure for a container having a threaded neck thereon, comprises a cap having an internally threaded cylindrical skirt with an annular end surface and a disc-shaped end wall for sealing engagement on the end of the threaded neck, a yieldable circular collar on the neck of the container in a position to be engaged by the end surface of the cap skirt, said yieldable collar being integral and unitary with the container and being continuous, and complementary projection and recess means on the skirt end surface and collar in a position to be cooperatively interengaged when the cap is threaded fully onto the neck of the container, said collar being yieldable by manual pressure thereon to release the interengaged projection and recess means to enable retrograde movement of the cap from the neck and having a substantially constant diameter and uniform shape, said collar projecting radially beyond the cap skirt a uniform distance for the entire circumference of said collar and beyond the cap skirt only sufficiently far enough to enable manual engagement and downward flexing thereof by an adult.

2. A child resistant closure as in claim 1, wherein the container is plastic and the collar is integrally formed therewith.

3. A child resistant closure as in claim 1, wherein the container is made of a non-flexible material and the collar is permanently secured thereto.

4. A child resistant closure as in claim 3, wherein the container comprises glass and the neck thereof has an annular channel therein, said collar being washer-shaped and engaged in said channel.

5. A child resistant closure for a container having a threaded neck thereon, comprises a cap having an internally threaded cylindrical skirt with an annular end surface and a disc-shaped end wall for sealing engagement on the end of the threaded neck, a yieldable collar on the neck of the container in a position to be engaged by the end surface of the cap skirt, the container comprising a metallic material and the collar including an integral radially outwardly and then inwardly formed portion of the neck, and complementary projection and recess means on the skirt end surface and collar in a position to be cooperatively interengaged when the cap is threaded fully onto the neck of the container, said collar being yieldable by manual pressure thereon to release the interengaged projection and recess means to enable retrograde movement of the cap from the neck and having a substantially constant diameter and uniform shape, said collar projecting radially beyond the cap skirt only sufficiently far enough to enable manual engagement and downward flexing thereof by an adult.

6. A child resistant closure for a container having a threaded neck thereon, comprises a cap having an internally threaded cylindrical skirt with an annular end surface and a disc-shaped end wall for sealing engagement on the end of the threaded neck, a yieldable collar on the neck of the container in a position to be engaged by the end surface of the cap skirt, the container being made of non-flexible material and having an opening and an adaptor which is secured in the container opening, said adaptor having a threaded neck for cooperation with the cap and having the collar integral therewith, said collar being permanently secured to the container, and complementary projection and recess means on the skirt end surface and collar in a position to be cooperatively interengaged when the cap is threaded fully onto the neck of the container, said collar being yieldable by manual pressure thereon to release the interengaged projection and recess means to enable retrograde movement of the cap from the neck and having a substantially constant diameter and uniform shape, said collar projecting radially beyond the cap skirt only sufficiently far enough to enable manual engagement and downward flexing thereof by an adult.

7. A child resistant closure as in claim 5, wherein the collar has the recess means therein and the cap has the projection means thereon.

8. A child resistant closure as in claim 1, wherein there is only a single projection and a single recess at one side of the collar and cap.

9. A child resistant closure as in claim 6, wherein the container has an internally threaded neck and the adaptor has a first externally threaded end engaged in the container neck and a second externally threaded end for cooperation with the cap, said collar being formed thereon between the ends.

10. A child resistant closure as in claim 8, wherein the cap has the recess therein in the annular end surface, said recess being defined by a radially enlarged portion on the skirt.

11. A child resistant closure as in claim 8, wherein the skirt has the projection thereon, said skirt being radially thickened at one side to accommodate the projection.

12. A child resistant closure for a container having a threaded neck thereon, comprises a cap having an end wall and a depending cylindrical side wall with internal threads therein, an adaptor having one end portion constructed to be secured and sealed in the threaded neck of the container and another end portion having external threads thereon for cooperation with the threaded cap, a flexible collar on said adaptor between the ends thereof in a position to be engaged by the cap side wall, and interfitting projection and recess means on the cap side wall and collar for latching the cap in closed position threaded fully onto the adaptor, said collar being yieldable to release the projection and recess means to enable retrograde movement of the cap from the container.

* * * * *